US006663360B1

(12) United States Patent
Kyer

(10) Patent No.: US 6,663,360 B1
(45) Date of Patent: Dec. 16, 2003

(54) FLUID INJECTION PUMP WITH INTERNAL AIR ACTUATOR VALVE

(76) Inventor: James A. Kyer, 3010 Kermit Hwy., Odessa, TX (US) 79763

( * ) Notice: Subject to any disclaimer, the term of this patent is extended or adjusted under 35 U.S.C. 154(b) by 0 days.

(21) Appl. No.: 10/178,850

(22) Filed: Jun. 25, 2002

(51) Int. Cl.[7] ..... F04B 17/00; F01L 15/12

(52) U.S. Cl. ..... 417/399; 417/401; 91/224; 91/344

(58) Field of Search ..... 417/392, 399, 417/401; 91/224, 235, 315, 344

(56) References Cited

U.S. PATENT DOCUMENTS 2,539,292 A * 1/1951 Anderson ..... 417/225
3,788,781 A * 1/1974 McClocklin ..... 417/401
3,963,383 A 6/1976 Hill
4,030,857 A * 6/1977 Smith, Jr. ..... 417/46
4,120,314 A 10/1978 Lissau
4,127,057 A * 11/1978 Stubenruss ..... 91/52
4,242,941 A 1/1981 Wilden et al.
4,645,431 A 2/1987 Spencer et al.
5,297,469 A 3/1994 Raymond
5,540,136 A * 7/1996 Noord ..... 91/224
6,102,363 A 8/2000 Eberwein
6,415,704 B1 * 7/2002 Wang ..... 91/224

* cited by examiner

*Primary Examiner*—Charles G. Freay
(74) *Attorney, Agent, or Firm*—Richard C. Litman

(57) ABSTRACT

A injection pump includes a needle valve which is disposed in the pump body cap. An air actuator valve is disposed in the pump piston head. The amount of air fed is controlled by the gap between the needle valve and a needle valve seat which is also located in the pump body cap. At the end of the pumping stroke, a spring on the air actuator valve contacts the bottom surface of the body cylinder chamber to cause the air actuator valve to open and release the trapped air from the body cylinder chamber through the air actuator valve so that the air can exit the pump. This action allows the spring around the piston and plunger to release and return the piston and plunger to the starting position.

16 Claims, 6 Drawing Sheets

FLUID INJECTION PUMP WITH INTERNAL AIR ACTUATOR VALVE

BACKGROUND OF THE INVENTION

1. Field of the Invention

The present invention relates generally to fluid pumps. More specifically, the invention is a pneumatic pump which includes an air actuator valve mounted in the pump's reciprocating piston head.

2. Description of Related Art

Prior art pneumatic pumps require an air actuator to control piston cycling. The air actuator is usually mounted on the exterior of the pump and comprises a conglomerate of various parts (screws, diaphragms, spools, o-rings, etc.) which make for a relatively complicated structure that is prone to break down and difficult to repair. A pump which eliminates the need for an externally mounted, complicated air actuator would certainly be a welcome addition to the art.

The relevant art of interest cited herein describes various fluid pumps and actuator valves, but none discloses the present invention. For example, U.S. Pat. No. 5,297,469 (Raymond) describes a power actuator wherein a piston functions as a control valve element. The piston's position is utilized to generate a signal which triggers a reversing valve. This arrangement employs complicated fluid circuitry.

U.S. Pat. No. 3,963,383 (Hill) discloses an air-driven pump. A shuttle valve for controlling the admission of pressurized air is mounted to the exterior of the pump.

U.S. Pat. No. 4,645,431 (Spencer et al.) shows a piston-driven hydraulic pump wherein the valve for controlling the entrance of pressurized air is mounted to the exterior of the pump.

U.S. Pat. No. 4,120,314 (Lissau), U.S. Pat. No. 4,242,941 (Wilden et al.) and U.S. Pat. No. 6,102,363 (Eberwein) are all drawn to actuator valve structure. The patentees do not contemplate mounting the valves in the head of a piston.

None of the above inventions and patents, taken either singly or in combination, is seen to disclose an injection pump and actuator valve as will subsequently be described and claimed in the instant invention.

SUMMARY OF THE INVENTION

The pneumatic fluid injection pump of the instant invention is preferably operated by air. It should be noted that other suitable gases may be utilized if desired. A needle valve which controls the supply of air is disposed in the pump body cap. An air actuator valve is disposed in the piston head. When the pump is in a starting position, the air valve actuator is in a closed position to prevent any passage of air. To start the pumping action, compressed air is fed directly through the pump body cap into the pump body cylinder chamber. The amount of air fed is controlled by the gap between the needle valve and a needle valve seat which is also located in the pump body cap. The air enters the body cylinder chamber and drives the piston and plunger rod through the fluid end of the pump. This action forces the liquid fluid out through a discharge check valve, and simultaneously closes a suction check valve. When the piston is pushed on its pumping stroke, a spring on the air actuator valve contacts a surface of the body cylinder chamber to cause the air actuator valve to open and release the trapped air through the air actuator valve so that the air can exit the pump. This action allows the spring around the piston and plunger to release and return the piston and plunger to the starting position in the body cylinder chamber. This return action causes the liquid to be drawn through the suction check valve into the pump, while simultaneously closing the discharge check valve. When the piston reaches its starting position in the body cylinder chamber, the air actuator valve returns to a closed position, thus allowing the cycle to repeat numerous times per second. The pneumatic injection pump having this internal air valve actuator injects the liquid by positive displacement caused by the reciprocating piston.

Accordingly, it is a principal object of the invention to provide an internal air actuator valve in a fluid injection pump.

It is another object of the invention to provide an internal air actuator valve incorporated in the head of a piston.

It is a further object of the invention to provide an air actuator valve having a compressive spring to elevate the valve upon reaching the end of a piston stroke.

Still another object of the invention is to provide a temporary holding element in the piston head to secure the elevated actuator valve.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
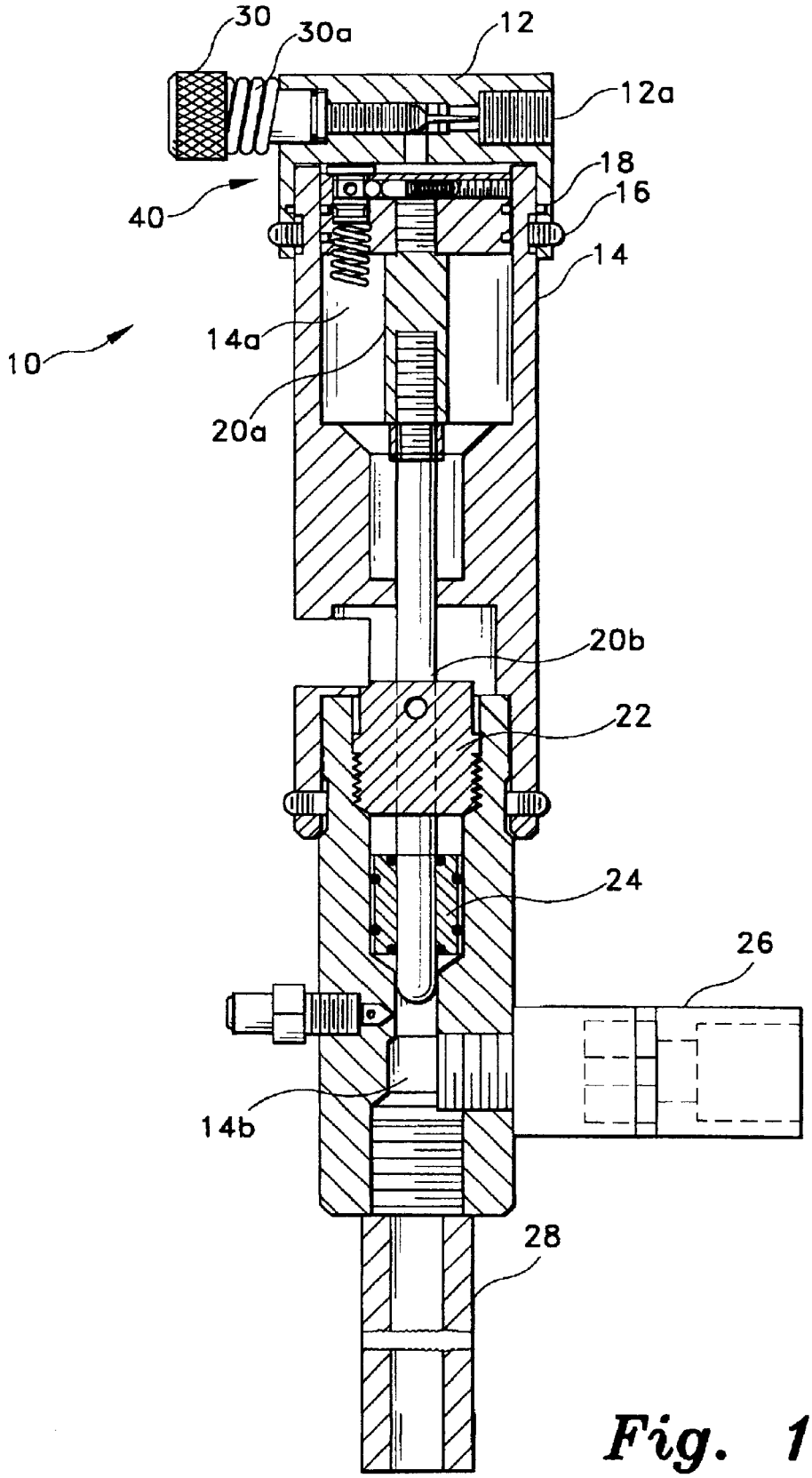
FIG. 1 is a partially cross-sectioned, plan view of the pneumatic fluid or chemical fluid injection pump incorporating the air actuator device in the piston head according to the present invention.
Figure 2A:
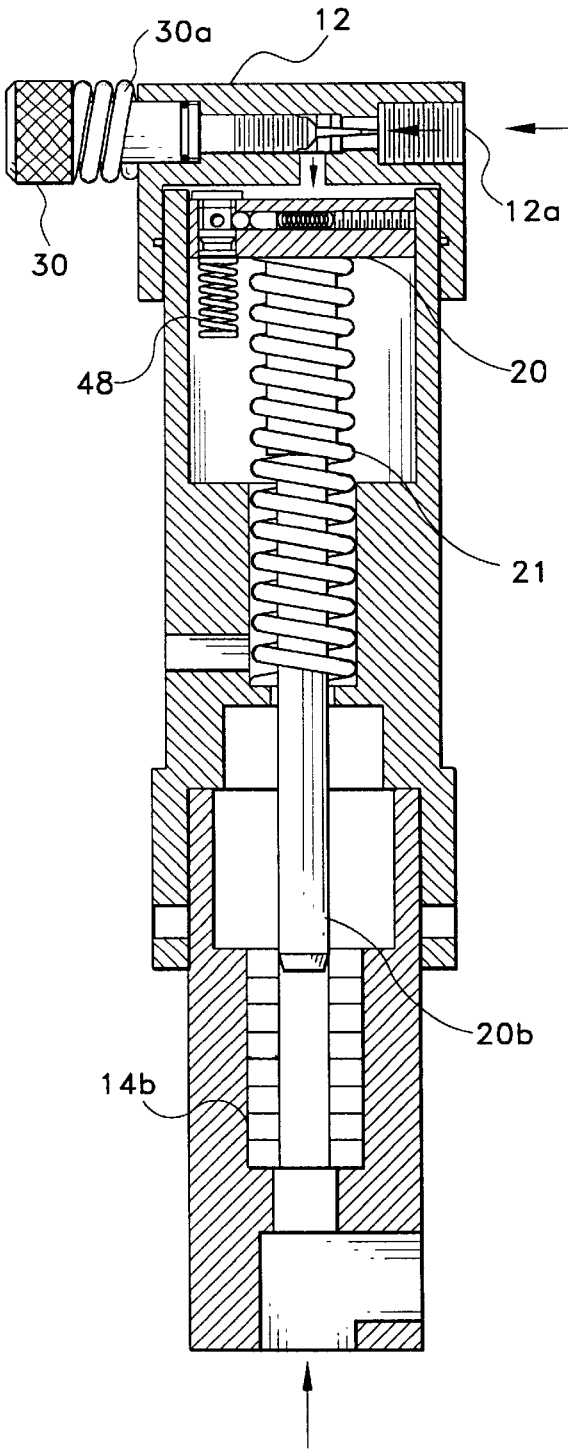
FIG. 2A is a partially cross-sectioned, plan view of a pneumatic fluid or chemical injection pump having an internal air actuator valve, which valve is in a closed position according to the present invention.
Figure 2B:
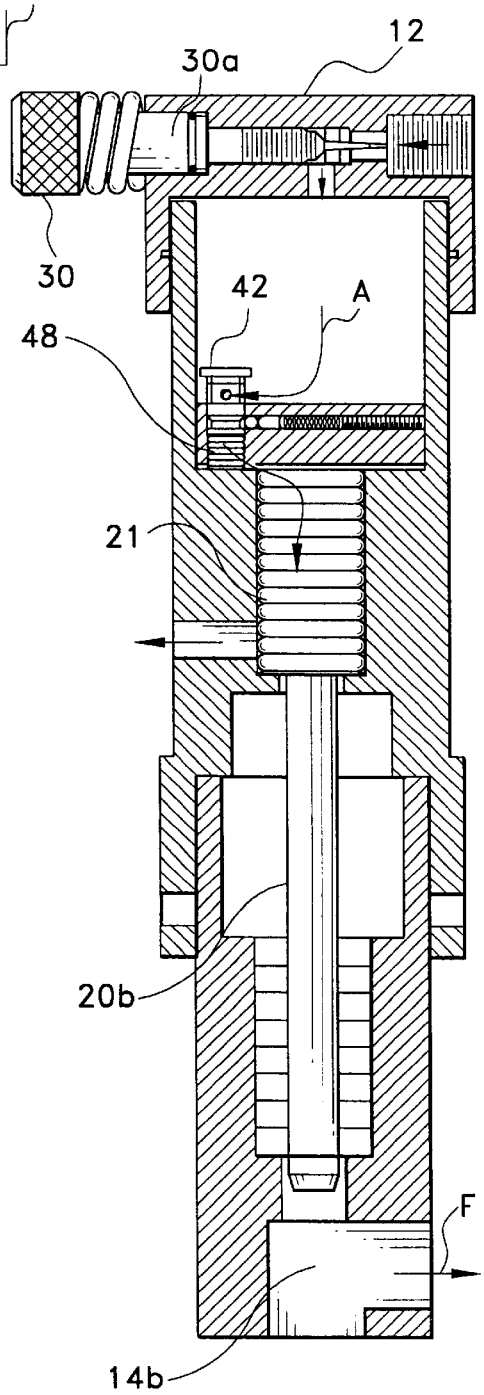
FIG. 2B is a partially cross-sectioned, plan view of a pneumatic fluid or chemical injection pump having an internal air actuator valve, which valve is in an open position according to the present invention.

Attention is first directed to FIGS. 1–2B wherein the pump and air actuator valve of the present invention is generally indicated at 10. The pump includes a pump body cap 12 mounted to the proximate end of a pump body cylinder 14 with set screws 16 or the like. O-rings 18 are utilized to insure a fluid-tight seal between cap 12 and body 14. A piston head 20 is mounted for reciprocating movement within a chamber 14*a* of body 14. A compression spring 21

(FIGS. 2A–2B) functions to bias piston head 20 toward the proximate end of body 14. Piston head 20 incorporates conventional piston stem 20*a* and plunger 20*b*. Packing nut 22 and packing seal 24 function to seal chamber 14*a* from a chamber 14*b*, which chamber 14*b* is disposed in the distal end of body 14. A discharge conduit 26 having a check valve therein is in fluid communication with chamber 14*b* and extends in a first direction from the distal end of body 14. A suction conduit 28 is also in fluid communication with chamber 14*b* and extends in a second direction from the distal end of body 14. Although the suction conduit and the discharge conduit are shown as extending in different directions (ninety degrees apart), it is contemplated that an additional opening can be provided in the wall of the body. As illustrated, the opening for the suction conduit may be plugged such that both discharge and suction conduits are positioned in substantially the same horizontal or vertical plane. Conduit 28 is provided with a check valve therein. A needle valve 30 provided with a compression spring 30*a* is disposed in cap 12 for controlling the flow of compressed air entering cap 12 via opening 12*a*. An air actuator valve 40 is disposed in piston head 20 for controlling the flow of air from chamber 14*a* as will be explained below.

Figure 3:
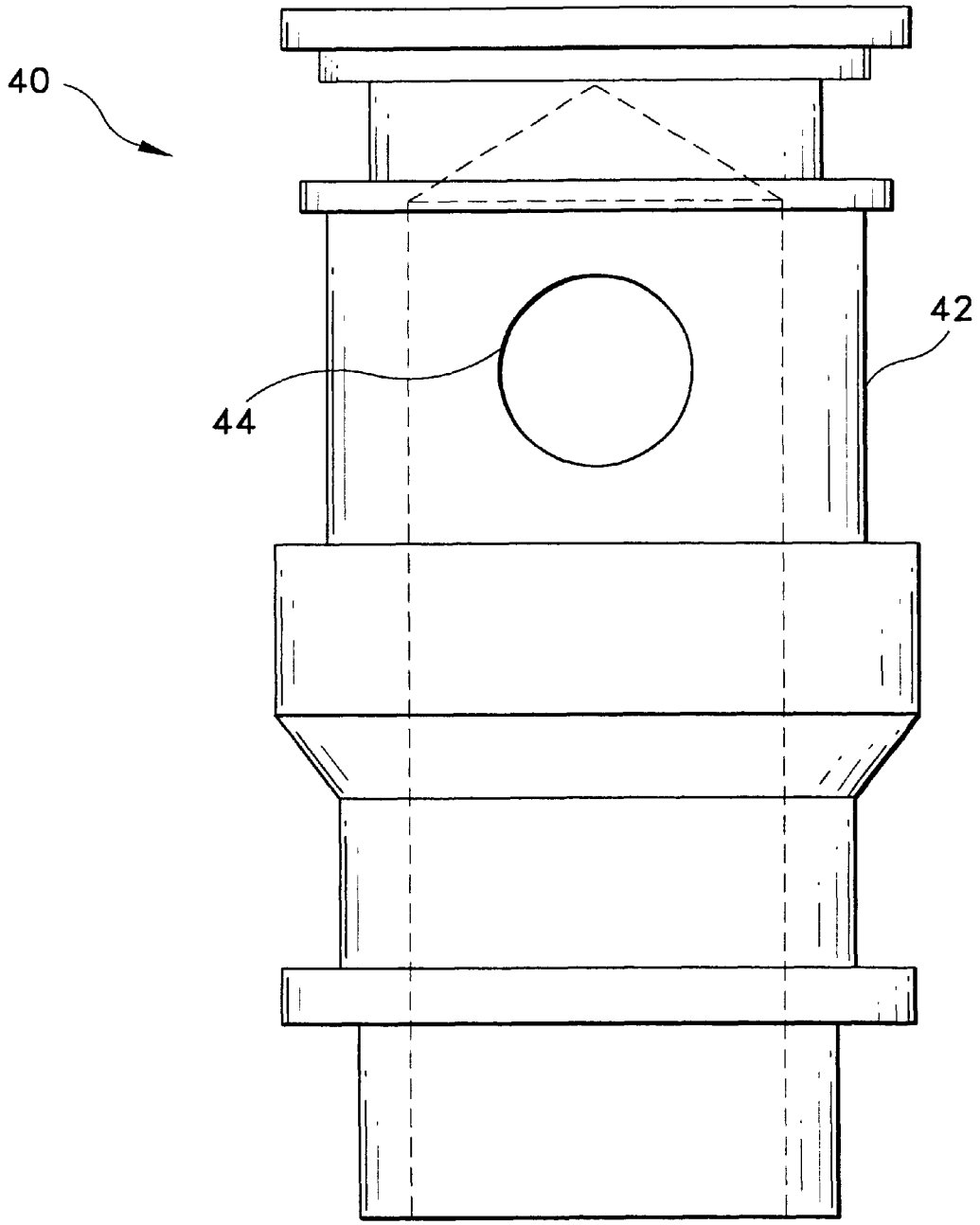
FIG. 3 is a side elevational view of the air actuator valve.
Figure 4:
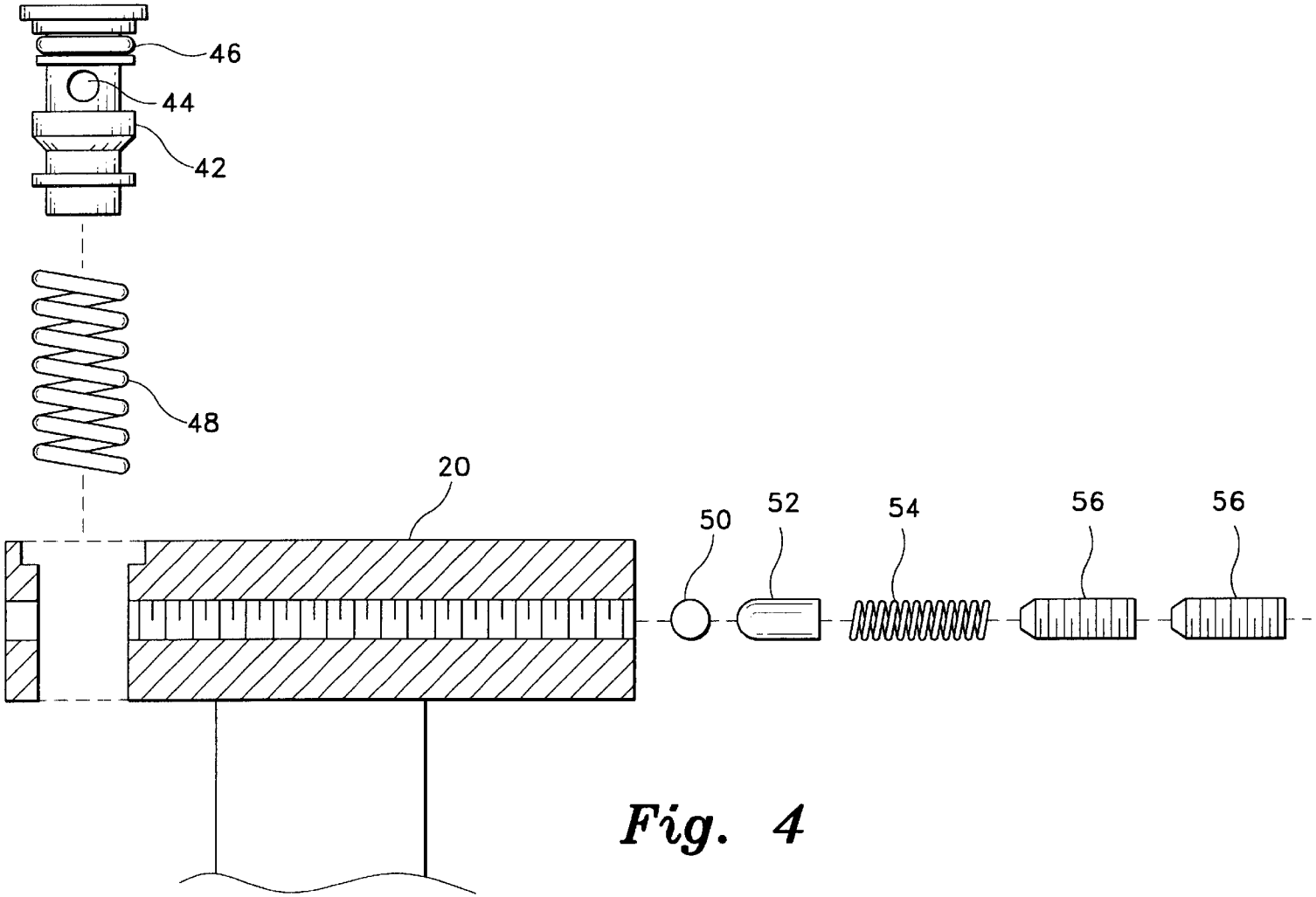
FIG. 4 is an exploded, partially cross-sectioned, elevational view of the air actuator valve and the piston head with the locking system according to the present invention.

As best viewed in FIGS. 3 and 4, air actuator valve 40 includes a hollow tubular member 42 having four openings 44 (only one is shown) in the peripheral wall thereof. Member 42 is disposed for telescopic movement within an opening formed in piston head 20. An O-ring 46 is fitted into a groove at the top of member 42. A compression spring 48 is fitted to one end of member 42. A stainless steel ball 50, spacer 52, spring 54 and a pair of set screws 56 function to hold member 42 in position in piston head 20. The tension on spring 54 is controlled and maintained by adjustment of the pair of set screws. It is important that the tension be maintained within a suitable range. If the tension is too loose, member 42 will be blown out of position. If the tension is too tight, member 42 will not be able to move in the piston head to release the air. Utilizing two set screws will allow for the necessary adjustment and maintenance thereof to insure optimum valve function.

Operation of the invention is best depicted in FIGS. 2A and 2B. As shown in FIG. 2A, valve 30 is opened to allow compressed air A to flow through opening 12*a* into contact with piston head 20. Actuator 40 is nested in the piston head so that no air can flow therethrough. The air pressure will cause piston head 20 to move toward the distal end of body 14 causing spring 21 to compress (FIG. 2B) and allowing plunger 20*b* to pump fluid F from chamber 14*b* through discharge conduit 26. When the piston head reaches the end of chamber 14*a*, spring 48 will contact a wall in the chamber and causing the spring to compress and move member 42 to a position (FIG. 2B) whereby air A can escape from chamber 14*a* and exit the pump body. This will allow spring 21 to return the piston head to its original position while causing fluid F to be drawn into chamber 14*b*. This cycle may be repeated at a rate determined by the adjustment of valve 30.

Figure 5:
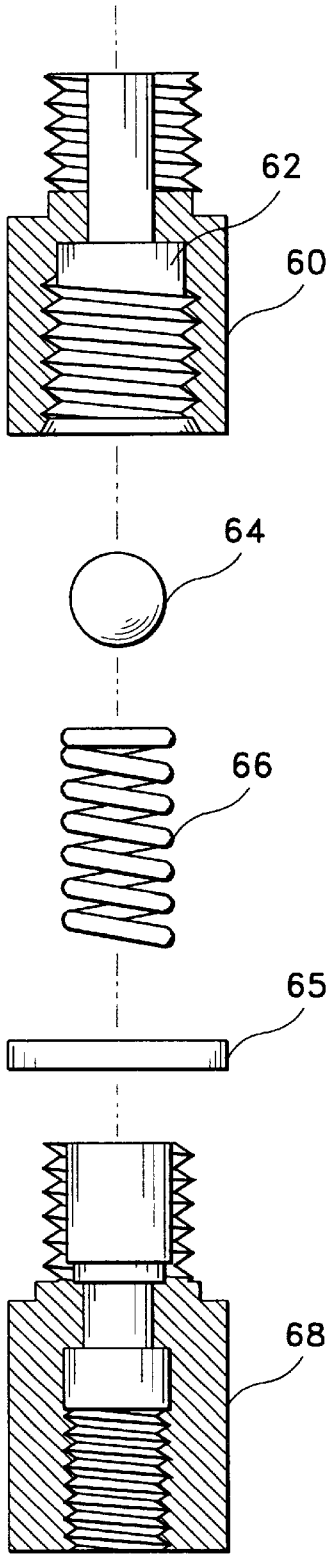
FIG. 5 is an exploded, partially cross-sectioned, elevational, view of the discharge check valve device according to the present, invention.

The check valves in conduits 26 and 28 will alternately open and close on the pumping and suction cycle. FIG. 5 illustrates a preferred form of a discharge check valve to be used with the pump. Valve conduit member 60 is adapted to fit into an opening in the body of the pump. Member 60 includes a PTFE seat 62 which functions to seat a stainless steel ball valve 64. Compression spring 66 biases ball 64 toward the seat. A second valve conduit member 68 is provided with a threaded nipple and is adapted to be threaded into member 60 for retaining spring 66 and ball 64 therein. A stainless steel seal 65 interposes member 60 and member 68. Fluid being discharged from the pump will move ball 64 against the bias of spring 66 to allow fluid to flow through members 60 and 68. During the suction cycle, retainer spring 66 prevents the ball from being sucked into the head on the upstroke. On the down stroke, fluid pressure seats the ball onto the PTFE seat.

Figure 6:
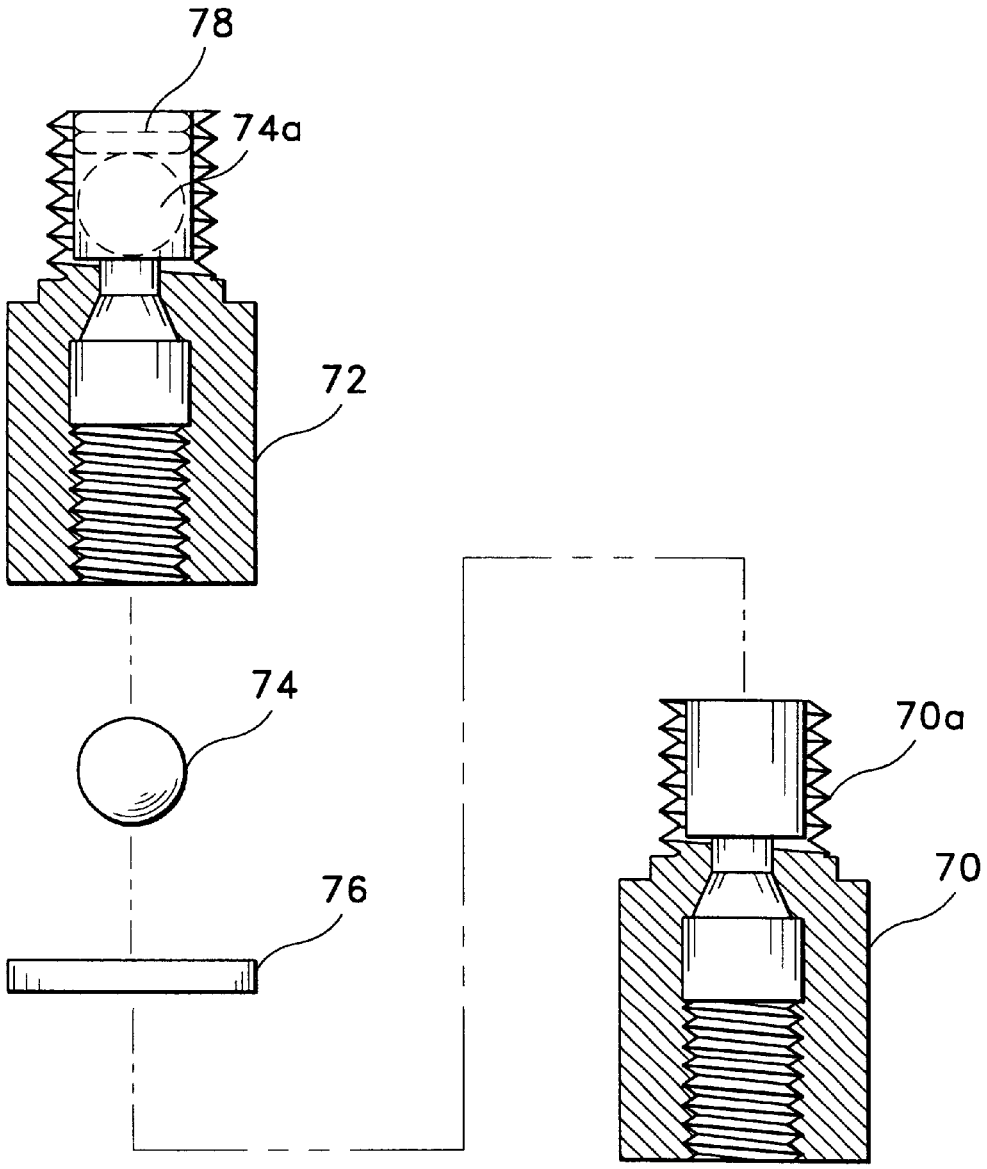
FIG. 6 is an exploded, partially cross-sectioned, elevational partial view of the suction check valve device according to the present invention.

FIG. 6 is illustrative of a preferred check valve arrangement utilized in suction conduit 28. In the instant arrangement valve member 70 having PTFE seat 70*a* is provided with a threaded nipple and is adapted to be threaded into valve member 72 which is also provided with a PTFE seat. A first stainless steel valve ball 74 and a stainless steel seal 76 interposes members 70 and 72. A second valve ball 74*a* and a retainer spring 78 (shown in phantom lines) are adapted to be disposed in member 72. During the pumping cycle, fluid pressure in chamber 14*a* will push valve ball 74*a* into contact with the PTFE seat in member 72 while at the same time, ball 74 will be seated against PTFE seat 70*a*, whereby a positive closure is attained. During the suction cycle, on the upstroke, balls 74 and 74*a* lift off the PTFE seats to allow fluid flow.

It is to be understood that the present invention is not limited to the embodiments described above, but encompasses any and all embodiments within the scope of the following claims.

I claim:

1. A fluid injection pump comprising:

a tubular body member, said body member having an elongate cylindrical wall, an open proximate end and an open distal end;

a first chamber housed within said body member, said first chamber positioned adjacent said proximate end;

a second chamber housed within said body member, said second chamber positioned adjacent said distal end;

a cap member, said cap member removably attached to said proximate end in fluid tight relationship;

a passageway disposed in said cap member, said passageway in fluid communication with said first chamber;

a first valve member, said first valve member disposed in said passageway for controlling fluid flow there through;

a piston head, said piston head positioned in said first chamber for reciprocal movement therein;

a second valve member, said second valve member disposed on said piston head;

said piston head being a disc shaped member having opposed planar surfaces;

an opening formed through said piston head and through said opposed planar surfaces, said second valve member positioned in said opening;

a bore disposed in said piston head parallel to said opposed planar surfaces, said bore terminating at said opening formed through said piston head; and a locking mechanism disposed in said bore for securing said second valve in said opening.

2. A fluid injection pump as recited in claim 1, wherein said locking mechanism includes a stainless steel ball, a spacer element, a compression spring and a pair of set screws.

3. A fluid injection pump as recited in claim 2, wherein said second valve member includes a hollow tubular member having a first end, a second end and a peripheral wall;

a plurality of openings in said peripheral wall adjacent said first end and evenly spaced there around; and a compression spring and an o-ring disposed on said second end.

4. A fluid injection pump as recited in claim 3, including a fluid suction conduit positioned at said distal end of said tubular body member, said suction conduit in fluid communication with said second chamber.

5. A fluid injection pump as recited in claim 4, including a suction check valve disposed in said suction conduit.

6. A fluid injection pump as recited in claim 5, wherein said suction check valve includes a pair of valve conduit members, a pair of stainless steel valve balls, a stainless steel seal and a compression spring.

7. A fluid injection pump as recited in claim 6, including a fluid discharge conduit positioned at said distal end of said tubular body member, said discharge conduit in fluid communication with said second chamber.

8. A fluid injection pump as recited in claim 7, including a discharge check valve disposed in said fluid discharge conduit.

9. A fluid injection pump as recited in claim 8, wherein said discharge check valve includes a pair of valve conduit members, a stainless steel seal, a stainless steel valve ball and a compression spring.

10. A fluid injection pump as recited in claim 9, wherein at least one of said pair of valve conduit members of said suction check valve and said discharge check valve is provided with PTFE seat.

11. A fluid injection pump comprising:

a tubular body member, said body member having an elongate cylindrical wall, an open proximate end and an open distal end;

a first chamber housed within said body member, said first chamber positioned adjacent said proximate end;

a second chamber housed within said body member, said second chamber positioned adjacent said distal end;

a cap member, said cap member removably attached to said proximate end in fluid tight relationship;

a passageway disposed in said cap member, said passageway in fluid communication with said first chamber;

a needle valve member, said needle valve member disposed in said passageway for controlling fluid flow there through;

a piston head, said piston head positioned in said first chamber for reciprocal movement therein;

a second valve member, said second valve member disposed on said piston head;

a fluid suction conduit positioned at said distal end of said tubular body member, said suction conduit in fluid communication with said second chamber;

a fluid discharge conduit positioned at said distal end of said tubular body member, said discharge conduit in fluid communication with said second chambers;

said piston head being a disc shaped member having opposed planar surfaces;

an opening formed through said piston head and through said opposed planar surfaces, said second valve member positioned in said opening;

a bore disposed in said piston head parallel to said opposed planar surfaces, said bore terminating at said opening formed through said piston head; and a locking mechanism disposed in said bore for securing said second valve in said opening.

12. A fluid injection pump as recited in claim 11, wherein said locking mechanism includes a stainless steel ball, a spacer element, a compression spring and a pair of set screws.

13. A fluid injection pump as recited in claim 12, wherein said second valve member includes a hollow tubular member having a first end, a second end and a peripheral wall;

a plurality of openings disposed in said peripheral wall adjacent said first end and evenly spaced there around; and a compression spring and an o-ring disposed on said second end.

14. A fluid injection pump as recited in claim 13, wherein a suction check valve is disposed in said suction conduit, wherein said suction check valve includes a pair of valve conduit members, a pair of stainless steel valve balls, a stainless steel seal and a compression spring.

15. A fluid injection pump as recited in claim 14, wherein a discharge check valve is disposed in said fluid discharge conduit, wherein said discharge check valve includes a pair of valve conduit members, a stainless steel seal, a stainless steel valve ball and a compression spring.

16. A fluid injection pump as recited in claim 15, wherein at least one of said pair of valve conduit members of said suction check valve and said discharge check valve is provided with a PTFE seat.

* * * * *